US007484830B2

(12) United States Patent
Kim et al.

(10) Patent No.: US 7,484,830 B2
(45) Date of Patent: Feb. 3, 2009

(54) INK-JET HEAD, INK-JET IMAGE FORMING APPARATUS INCLUDING THE INK-JET HEAD, AND METHOD FOR COMPENSATING FOR DEFECTIVE NOZZLE

(75) Inventors: Tae-kyun Kim, Yongin-si (KR); Uchikata Yoshio, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 403 days.

(21) Appl. No.: 11/292,006

(22) Filed: Dec. 2, 2005

(65) Prior Publication Data

US 2006/0256157 A1 Nov. 16, 2006

(30) Foreign Application Priority Data

May 10, 2005 (KR) ..... 10-2005-0039003

(51) Int. Cl.
*B41J 2/14* (2006.01)
*B41J 2/16* (2006.01)

(52) U.S. Cl. ..... 347/47; 347/42; 347/15

(58) Field of Classification Search ..... 347/14, 347/15, 19, 5, 9, 40, 42, 44, 47
See application file for complete search history.

(56) References Cited

U.S. PATENT DOCUMENTS

| | | | | |
|---|---|---|---|---|
| 5,412,410 | A * | 5/1995 | Rezanka | 347/15 |
| 5,581,284 | A | 12/1996 | Hermanson | 347/43 |
| 5,587,730 | A | 12/1996 | Karz | 347/43 |
| 6,089,693 | A * | 7/2000 | Drake et al. | 347/19 |
| 6,439,681 | B1 * | 8/2002 | McClellan | 347/14 |
| 6,565,180 | B2 | 5/2003 | Yu et al. | 347/19 |
| 7,108,352 | B2 * | 9/2006 | Muraoka | 347/40 |
| 7,192,114 | B2 * | 3/2007 | Suzuki et al. | 347/19 |

FOREIGN PATENT DOCUMENTS

| | | |
|---|---|---|
| JP | 6-238902 | 8/1994 |
| JP | 2002-86767 | 3/2002 |
| JP | 2002-219813 | 8/2002 |

* cited by examiner

*Primary Examiner*—Juanita D Stephens
(74) *Attorney, Agent, or Firm*—Stein, McEwen & Bui, LLP

(57) ABSTRACT

An ink-jet image forming apparatus includes an ink-jet head having a nozzle unit including a first nozzle array having a plurality of nozzles of different sizes and at least one second nozzle array disposed parallel to the first nozzle array and having a plurality of nozzles of different sizes. A method of compensating for the defective nozzle includes: detecting a defective nozzle of the first nozzle array; and compensating for missing dots of the defective nozzle using the second nozzle array.

26 Claims, 9 Drawing Sheets

INK-JET HEAD, INK-JET IMAGE FORMING APPARATUS INCLUDING THE INK-JET HEAD, AND METHOD FOR COMPENSATING FOR DEFECTIVE NOZZLE

CROSS-REFERENCE TO RELATED APPLICATION

This application claims the benefit of Korean Patent Application No. 2005-39003, filed on May 10, 2005 in the Korean Intellectual Property Office, the disclosure of which is incorporated herein in its entirety by reference.

BACKGROUND OF THE INVENTION

1. Field of the Invention

Aspects of the present invention relate to an ink-jet image forming apparatus, and more particularly, to an ink-jet image forming apparatus that can compensate for image quality degradation caused by defective nozzles.

2. Description of the Related Art

An ink-jet image forming apparatus forms images by firing ink from an ink-jet head onto a printing medium. The ink-jet head is placed a predetermined distance apart from the printing medium and reciprocally moves in a direction perpendicular to the transferring direction of the printing medium. Such ink-jet image forming apparatus is referred to as a shuttle type ink-jet image forming apparatus. An ink-jet head of the shuttle type ink-jet image forming apparatus includes a nozzle unit on which a plurality of nozzles that fire ink are formed.

Recently, an ink-jet head having a nozzle unit with a length corresponding to the width of printing medium has been used to realize high-speed printing. An image forming apparatus operating in this way is referred to as a page width ink-jet image forming apparatus. An ink-jet head of the page width ink-jet image forming apparatus is fixed and only a printing medium is transferred. Accordingly, a driving device of the ink-jet image forming apparatus is simple and high-speed printing is possible.

FIG. 1A shows printing patterns when a nozzle unit of a conventional ink-jet image forming apparatus is missing or not working, and FIG. 1B shows dots actually printed by the conventional ink-jet image forming apparatus. FIGS. 2A through 2D are pixel images for explaining a method for compensating for a defective nozzle unit of the conventional ink-jet image forming apparatus. FIG. 3 is a view for explaining a method for compensating for the defective nozzle unit using a secondary ink-jet head in the conventional ink-jet image forming apparatus.

Referring to FIG. 1A, the ink-jet image forming apparatus forms an ink image by firing ink I from nozzles 82 formed in a nozzle unit 80 onto a printing medium. The conventional nozzle unit 80 is installed in the direction perpendicular to the transferring direction of the printing medium, and fires ink onto the printing medium. Thus, when a nozzle 84 is defective, a visible line is generated on the printing medium as shown in FIG. 1A. Such a white line is easily visible, and thus affects printing quality. Further, as shown in FIG. 1B, when the conventional ink-jet image forming apparatus prints a straight line, the line is very uneven due to dot spreading on the printing medium. In other words, since the nozzles of the conventional invention have the same size, the printing quality is deteriorated due to the dot spreading.

A shuttle type ink-jet image forming apparatus prints an image in an overlapping manner by reciprocally moving a carriage several times to compensate for the printing quality deterioration due to a missing or not working nozzle. Such a method is known as a shingling method. In a page width ink-jet image forming apparatus, an ink-jet head is mounted perpendicular to the transferring direction of a printing medium, and does not reciprocally travel in the width direction of the printing medium. That is, there is a specific area on the printing medium on which a nozzle must print an image at a particular moment during printing. If the nozzle does not print an image or malfunctions at a particular moment, a white line is generated on the area where the printing is not performed as illustrated in FIG. 1A, and thus image quality is degraded.

A method for compensating for deterioration of image quality due to a missing or not working nozzle is disclosed in U.S. Pat. No. 5,581,284. FIGS. 2A through 2D are the same drawings illustrated in FIGS. 3 through 6 of U.S. Pat. No. 5,581,284. Referring to FIGS. 2A through 2D, the defective nozzle indicates a case when a nozzle does not normally fire ink, or is missing, in the pixel image 60 as the printing medium 18 is moved in the direction of the arrow 62. When a defective nozzle 63 for firing mono (i.e., black) ink is identified, ink droplets of other colors (i.e., cyan, magenta, and yellow) are sequentially fired to a pixel region 63 to which the defective nozzle should have fired black ink. The black ink was fired correctly in pixels 61. These processes are illustrated in FIGS. 2B, 2C, and 2D. As described above, the black color can be represented by printing the cyan, magenta, and yellow ink droplets on the same location of the printing medium, and the represented black is called process black or composite black. However, this method is useful to compensate for a defect of a nozzle firing black ink, but does not compensate for a defect of any of the nozzles firing other colors. Moreover, since the nozzles for cyan, magenta, and yellow ink do not operate when only the black color is printed, the process black can be formed using the color nozzles. However, when a color image is printed, the nozzles for cyan, magenta, and yellow ink operate, and the compensation cannot be performed. Further, when one of the nozzles used for compensation malfunctions, other colors such as red (yellow+magenta), green (cyan+yellow), or blue (cyan+magenta) color are printed, and thus printing quality is deteriorated.

A method for compensating for deterioration of image quality due to a defective nozzle in an ink-jet printer 10 is disclosed in U.S. Pat. No. 5,587,730. FIG. 3 is the same drawing illustrated in FIG. 2 of the above U.S. patent. The ink-jet printer 10 includes a maintenance station 12, a paper feeder 2, a paper transport 4 and a dryer 6. The method for compensating for a missing dot generated by a failed ink-jet head 20*a* includes connecting a secondary ink-jet head 20*e* to the same ink tank 8*a* as the failed ink-jet head 20*a* to use the same color and simultaneously operating the secondary ink-jet head 20*e* and the failed ink-jet head 20*a*. Using this method, missing dots of all colors due to defective nozzles can be compensated when a plurality of ink-jet heads are used, but the cost of the image forming apparatus increases since the number of ink-jet heads increases. Further, the same color is used to compensate for the missing dot, and therefore, the double ink-jet heads are required to compensate for the missing dots of all colors.

SUMMARY OF THE INVENTION

Aspects of the present invention provide an ink-jet image forming apparatus capable of minimizing an influence of a defective nozzle on image quality and a method of compensating for the defective nozzle.

Aspects of the present invention also provide an ink-jet image forming apparatus capable of overcoming the limitation (i.e., compensation for only black color) of a conventional invention and minimizing an influence of a defective nozzle on image quality regardless of ink colors and a method for compensating for a defective nozzle.

Aspects of the present invention also provide an ink-jet image forming apparatus capable of maintaining appropriate image quality using nozzles of different sizes and a method for compensating for a defective nozzle.

According to an aspect of the present invention, there is provided an ink-jet head comprising: a nozzle unit including a first nozzle array having a plurality of nozzles of different sizes and at least one second nozzle array disposed parallel to the first nozzle array and having a plurality of nozzles of different sizes.

In accordance with an aspect of the present invention, nozzles of different sizes are alternately arranged in the first nozzle array.

In accordance with an aspect of the present invention, nozzles of different sizes are alternately arranged in the second nozzle array.

In accordance with an aspect of the present invention, the nozzles of the first nozzle array and the nozzles of the second nozzle array are disposed parallel to a feeding direction of a printing medium, and the sizes of opposite nozzles of the first nozzle array and the second nozzle array are different from each other.

In accordance with an aspect of the present invention, pairs of large and small nozzles are alternately arranged in each of the first nozzle array and second nozzle array.

In accordance with an aspect of the present invention, the length of the nozzle unit corresponds to the width of the printing medium.

According to another aspect of the present invention, there is provided an ink-jet image forming apparatus comprising: an ink-jet head including a nozzle unit having a first nozzle array in which pairs of large and small nozzles are alternately arranged and at least one second nozzle array which is disposed parallel to the first nozzle array and in which pairs of large and small nozzles are alternately arranged.

In accordance with an aspect of the present invention, the nozzles arranged in the first nozzle array and the nozzles arranged in the second nozzle array are disposed parallel to a feeding direction of a printing medium, and the sizes of opposite nozzles in the first nozzle array and the second nozzle array are different from each other.

In accordance with an aspect of the present invention, the length of the nozzle unit may correspond to the width of the printing medium.

According to still another aspect of the present invention, there is provided a method for compensating for a defective nozzle in an ink-jet image forming apparatus which includes a nozzle unit having a first nozzle array including a plurality of nozzles of different sizes and a second nozzle array disposed parallel to the first nozzle array and including a plurality of nozzles of different sizes, the method comprising: detecting a defective nozzle of the first nozzle array; and compensating for missing dots of the defective nozzle using the second nozzle array.

In accordance with an aspect of the present invention, the nozzles of different sizes of the first nozzle array are alternately arranged.

In accordance with an aspect of the present invention, the nozzles of different sizes of the second nozzle array are alternately arranged.

In accordance with an aspect of the present invention, pairs of large and small nozzles are alternately arranged in each of the first nozzle array and second nozzle array, the nozzles on each of the first nozzle array and second nozzle array are disposed parallel to a transferring direction of a printing medium, and the sizes of opposite nozzles of the first nozzle array and the second nozzle array are different from each other.

In accordance with an aspect of the present invention, in the compensating for the missing dots, the missing dots of the large nozzle of the first nozzle array are compensated for using the small nozzle of the second nozzle array. Each of the missing dots of the large nozzle is compensated for using at least a dot of the small nozzle. The dots are fired from the small nozzle such that the difference in optical density when the large nozzle normally fires ink dots and when the small nozzle compensates for the defect of the large nozzle is less than 0.2.

In accordance with an aspect of the present invention, in the compensating for the missing dots, the missing dots of the small nozzle of the first nozzle array are compensated for using the large nozzle of the second nozzle array. The missing dots of the small nozzle are compensated for using fewer dots of the large nozzle than the missing dots. The dots are fired from the large nozzle such that the difference in optical density when the small nozzle normally fires ink dots and when the large nozzle compensates for the defect of the small nozzle is less than 0.2.

In accordance with an aspect of the present invention, the length of the nozzle unit corresponds to the width of the printing medium.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
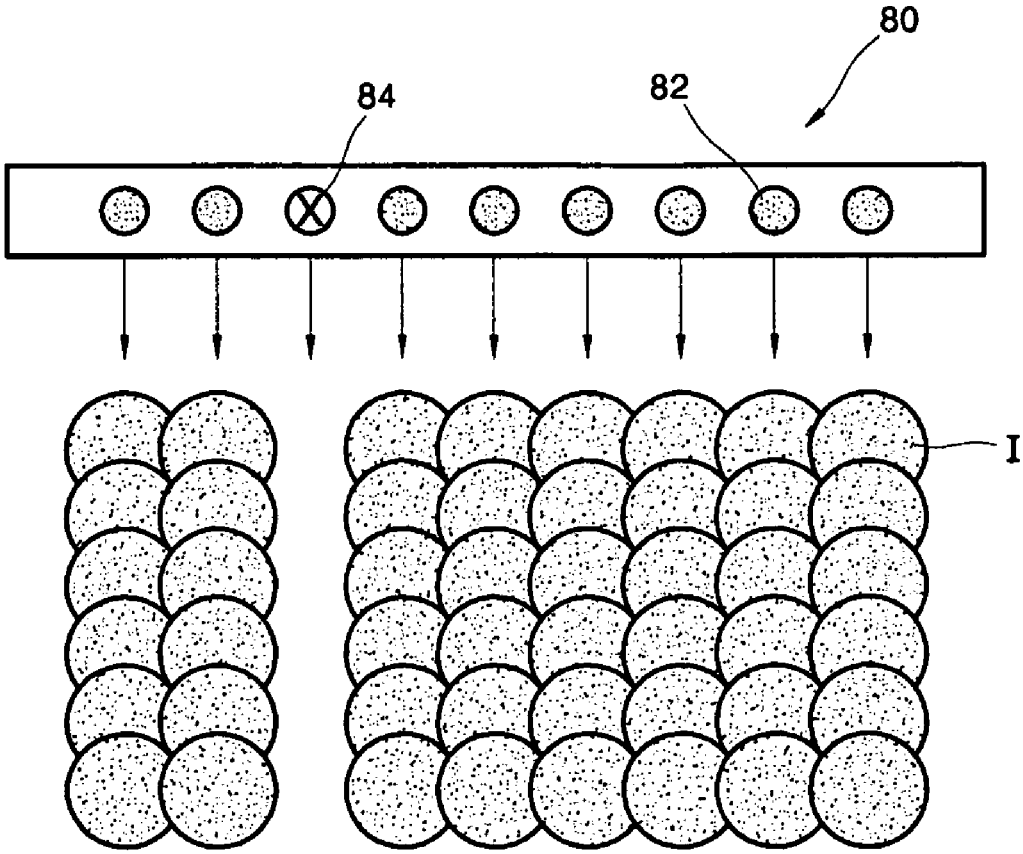
FIG. 1A (RELATED ART)
FIG. 1A shows printing patterns when a nozzle unit of a conventional ink-jet image forming apparatus is missing or not operating.

Reference will now be made in detail to the present embodiments of the present invention, examples of which are illustrated in the accompanying drawings, wherein like reference numerals refer to the like elements throughout. The embodiments are described below in order to explain the present invention by referring to the figures. In the example embodiment, an ink-jet image forming apparatus including ink-jet heads and a method for compensating for a defective nozzle will now be described more fully with reference to the accompanying drawings, in which exemplary embodiments of the invention are shown. For convenience of explanation, the entire structure of the ink-jet image forming apparatus will be first described, and then the method for compensating for the defective nozzle will be described. Further, a page width ink-jet image forming apparatus, which includes a nozzle unit of which length corresponds to the width of a printing medium, will be described as the ink-jet image forming apparatus according to aspects of the present invention. In the drawings, the thicknesses of lines and sizes are exaggerated for clarity and convenience.

Figure 4:
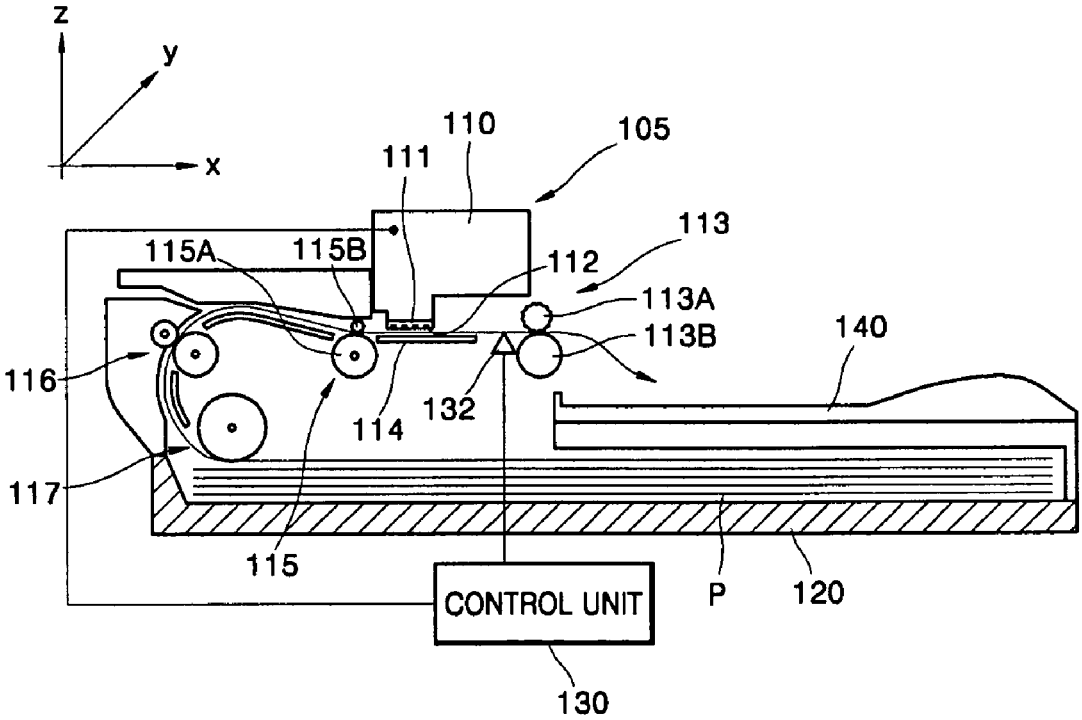
FIG. 4 is a cross-sectional view of an ink-jet image forming apparatus according to an embodiment of the present invention.
Figure 5:
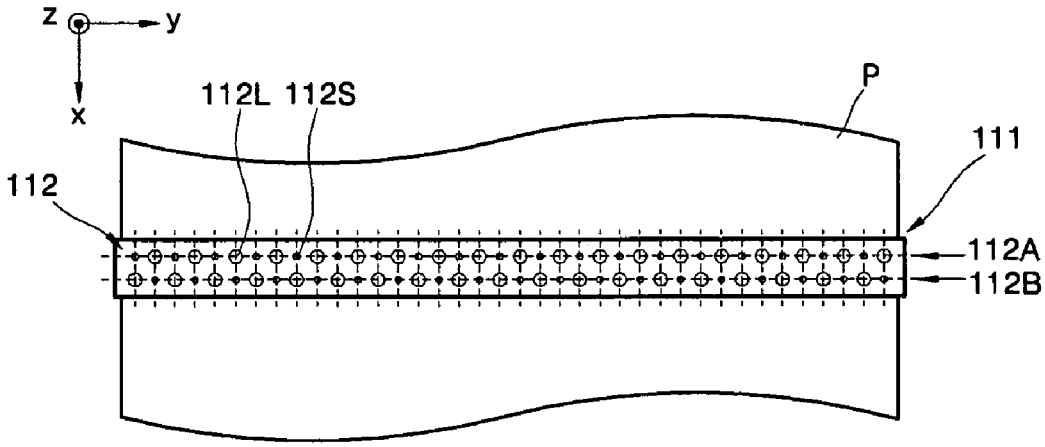
FIG. 5 is a bottom view of an ink-jet head unit shown in FIG. 4.
Figure 6:
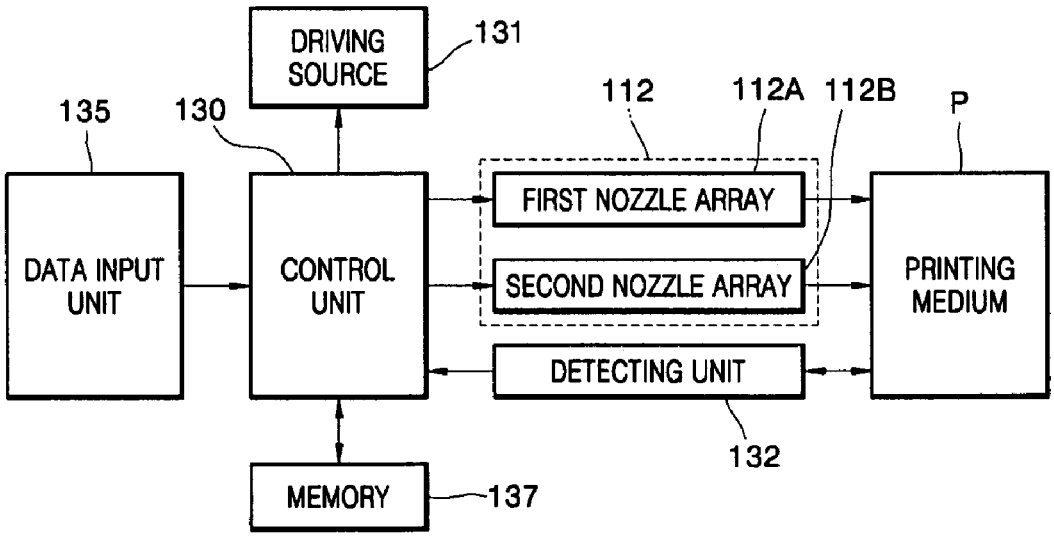
FIG. 6 is a block diagram of processes of detecting a defective nozzle according to an embodiment of the present invention.

FIG. 4 is a cross-sectional view of an ink-jet image forming apparatus according to an embodiment of the present invention. FIG. 5 is a bottom view of the ink-jet head unit shown in FIG. 4. FIG. 6 is a functional block diagram of the ink-jet image forming apparatus of detecting a defective nozzle according to an embodiment of the present invention.

Referring to FIG. 4, the ink-jet image forming apparatus includes a feeding cassette 120, an ink-jet head unit 105, a supporting member 114 opposite to the ink-jet head unit 105, a printing medium conveying unit that conveys a printing medium P along a predetermined path, and a stacking unit 140 on which the discharged printing medium P is stacked. The printing medium P is stacked on the feeding cassette 120. The printing medium P is conveyed from the feeding cassette 120 to an ink-jet head 111 by the printing medium conveying unit. The printing medium P is conveyed in the X direction, and the Y direction is the width direction of the printing medium P. The printing medium conveying unit conveys the printing medium P along a predetermined path, and includes a pick-up roller 117, a feeding roller 115, and a discharging roller 113. The printing medium conveying unit is driven by a driving source (not shown) such as a motor, and provides a transferring force to convey the printing medium P. However, it is understood that the printing medium P can be otherwise conveyed before the ink-jet head unit 105, and that the feeding cassette 120 need not be used in all aspects of the invention.

The pick-up roller 117 is installed in one side of the feeding cassette 120, picks up the printing medium P and draws printing medium P out by rotating while pressing a top surface of the printing medium P. The feeding roller 115 is mounted in front of the ink-jet head 111 and conveys the printing medium P from the pick-up roller 117 to the ink-jet head 111. While not required in all aspects, the shown feeding roller 115 aligns the printing medium P before the printing medium P passes through the ink-jet head 111 such that ink can be fired to a desired position on the printing medium P. The feeding roller 115 comprises a driving roller 115*a* to supply a transferring force to convey the printing medium P, and an idle roller 115B elastically engaged with the driving roller 115A. While not required in all aspects, an auxiliary roller 116 is installed between the pick-up roller 117 and the feeding roller 115.

The discharging roller 113 is installed in a portion where the printing medium P is discharged, and discharges the printing medium P on which printing is completed out of the image forming apparatus. The discharged printing medium P is stacked on the stacking unit 140. The shown discharging roller 113 includes a star wheel 113A installed in a width direction of the printing medium P, and a supporting roller 113B which is opposite to the star wheel 113A and supports a rear surface of the printing medium P. The printing medium P may wrinkle due to ink fired onto a top surface of the printing medium P while passing the nozzle unit 112. When the printing medium P is severely wrinkled, the printing medium P contacts the bottom surface of the nozzle unit 112 or body 110, and thus, since the ink that is not yet dried is spread, an image already printed may be contaminated by ink. The distance between the printing medium P and the nozzle unit 112 may not be maintained due to the wrinkles of the printing medium P. The star wheel 113A prevents the printing medium P passing the lower portion of the nozzle unit 112 from contacting the bottom surface of the nozzle unit 112 or body 110, or prevents the distance between the printing medium P and the bottom surface of the nozzle unit 112 or body 110 from being changed. The star wheel 113A is installed such that at least a portion of the star wheel 113A protrudes from the nozzle unit 112, and contacts at a point of the top surface of the printing medium P. According to the above structure, the star wheel 113A contacts the point of the top surface of the printing medium P so that an ink image that has been fired from the nozzle unit 112 and is not yet dried is not contaminated.

However, it is understood that other discharge units can be used with other aspects of the present invention. For instance, a plurality of star wheels may be installed to smoothly convey the printing medium P. When the plurality of star wheels are installed in parallel with the transferring direction of the printing medium P, a plurality of supporting wheels corresponding to each of the star wheels may be further installed.

According to an aspect of the invention, an individual drying device (not shown) is further installed. Specifically, when printing is continuously performed, a printing medium P is discharged and stacked on the stacking unit 140 and subsequently the next printing medium P is discharged before the ink on the top surface of the previous printing medium P is dried, so that the rear surface of the printing medium P may be contaminated by ink. To prevent this problem, the individual drying device (not shown) is further installed.

The supporting member 114 is installed under the ink-jet head 111 and supports the rear surface of the printing medium P to maintain a predetermined distance between the nozzle unit 112 and the printing medium P. The shown distance between the nozzle unit 112 and the printing medium P is about 0.5-2.5 mm, but may be other distances according to other aspects of the invention.

The ink-jet head unit 105 prints an image by firing ink onto the printing medium P, and includes the body 110, the ink-jet head 111 installed on the bottom surface of the body 110, and a nozzle unit 112 formed on the ink-jet head 111. The feeding roller 115 is rotatably installed in the front of the nozzle unit 112 where the printing medium P is conveyed into the nozzle unit 112, and the discharging roller 113 is rotatably installed in a portion where the printing medium P is discharged from the nozzle unit 112. A plurality of nozzle arrays for firing ink is formed on the nozzle unit 112. While not required in all aspects, the nozzle unit 112 corresponds to the width of the printing medium P or be formed longer than the width of the printing medium P. That is, the ink-jet head 111 according to aspects of the present invention may be employed by a page width ink-jet image forming apparatus which forms an image by firing ink from the nozzle unit 112 having a length that corresponds to the width of the printing medium P.

Although not illustrated in FIG. 4, an ink container is provided in the body 110. Further, the body 110 includes chambers, each of which has firing units (for example, piezoelectric elements or heat-driving type heaters) that are connected to respective nozzles of the nozzle units 112 and provide pressure to fire the ink, channels (for example, orifices) for supplying the ink contained in the body 110 to each chamber, a manifold that is a common channel for supplying the ink flowed through the channel to the chamber, and a restrictor that is an individual channel for supplying the ink from the manifold to each chamber. The chambers, the firing units, the channel, the manifold, and the restrictor are well-known to a person having ordinary skill in the art, and thus the detailed descriptions thereof will not be presented.

The single color nozzle unit firing ink is described as an example in the present embodiment. However, the form of the nozzle unit according to aspects of the present invention can vary, and the technical scope of the present invention is not limited to FIG. 5. Further, a first nozzle array 112A may act as a second nozzle array 112B, or the second nozzle array 112B may act as the first nozzle array 112A.

Referring to FIGS. 5 and 6, the ink-jet head 111 includes the nozzle unit 112 corresponding to approximately the width of the printing medium P. The nozzle unit 112 includes a first nozzle array 112A having a plurality of nozzles of different sizes, and at least a second nozzle array 112B disposed in parallel with the first nozzle array 112A and having a plurality of nozzles of different sizes. The nozzles of different sizes are alternately arranged in the first nozzle array 112A. The nozzles of different sizes are also alternately arranged in the second nozzle array 112B. While described in terms of two arrays 112A, 112B, it is understood that additional rows can be used according to aspects of the invention.

The nozzles of the first nozzle array 112A and the second nozzle array 112B are disposed in parallel with the transferring direction of the printing medium P, and the disposed nozzles have different sizes. Specifically, the nozzles of the first nozzle array 112A and the nozzles of the second nozzle array 112B are arranged in a checked pattern to correspond to each other in a one-to-one manner in the X direction such that the adjacent nozzles have different sizes. In the present embodiment, each of nozzles of the first nozzle array 112A and second nozzle array 112B is disposed in parallel with the transferring direction of the printing medium P, but it is understood that each of the nozzles can be disposed in other patterns, such as a zigzag pattern.

In another embodiment, in each of the first nozzle array 112A and second nozzle array 112B, small and large nozzles 112S and 112L are alternately disposed. If the small and large nozzles 112S and 112L are alternately disposed, when a nozzle in the first nozzle array 112A is defective, the effect of the defective nozzle can be effectively compensated for using the second nozzle array 112B. The firing operation of each of the first nozzle array 112A and second nozzle array 112B is controlled by a control unit 130 which will be described later. The second nozzle array 112B is used for a general printing operation, or compensating for a defective nozzle when a detecting unit 132 which will be described later detects the defective nozzle of the first nozzle array 112A. The second nozzle array 112B may be installed in the same ink-jet head as the first nozzle array 112A, or be installed in an individual ink-jet head. Moreover, on each of the first nozzle array 112A and second nozzle array 112B, nozzles may be aligned in a line (referring to FIG. 5), or may be divided into a plurality of groups and disposed in a zigzag pattern (referring to FIG. 13). As described above, the first nozzle array 112A and the second nozzle array 112B can be modified in various forms, and theses modifications are embodiments of the present invention and do not depart from the technical scope of the present invention.

In another embodiment, the second nozzle array 112B may fire the same color ink as the first nozzle array 112A, or fire different color ink. When the second nozzle array 112B fires ink of a color different from that of the first nozzle array 112A, it is advantageous that the color of ink fired from the second nozzle array 112B has lower brightness or chroma than the ink fired from the first nozzle array 112A. This is because when the color of the ink used for compensation has a relatively low brightness or chroma, the color is less visible, and thereby, the compensation effect is improved. Further, it is advantageous that the second nozzle array 112B is disposed to meet the conveyed printing medium P earlier than the first nozzle array 112A. This is because ink of a color having lower brightness or chroma printed prior to ink of a color having higher brightness or chroma is less visible.

Referring to FIGS. 4 and 6, the detecting unit 132 detects the defective nozzle of the nozzle unit 112 formed on the ink-jet head 111. That is, the detecting unit 132 detects the defective nozzle of the first nozzle array 112A or second nozzle array 112B. The defective nozzle denotes a case where a nozzle is missing or malfunctioning. For instance, when a heater used for firing ink is disconnected, a driving circuit of the heater is broken or an electrical element such as a filed emission transistor is damaged, the detecting unit 132 can easily detect the defective nozzle. Further, when ink is fired by driving a piezoelectric element, the detecting unit 132 can easily detect the defective nozzle due to the defective piezoelectric element or damage to a driving circuit of the piezoelectric element. However, the cause of the defective nozzle may not be clearly identified. In general, test page printing is performed to detect a defective nozzle. A portion where printing is performed by a defective nozzle has a lower printing density, which can be detected using the detecting unit 132 such as a light sensor. The light sensor includes a light emitting sensor (for example, a light emitting diode) that scans light onto a printing medium P and a light receiving sensor that receives light reflected from the printing medium P. A signal output from the light receiving sensor is input to the detecting unit 132 and transmitted to the control unit 130 which will be described later. The light emitting sensor and the light receiving sensor may be integrated with each other or may be separately included in the light sensor. The structure and effect of the light sensor is well-known to those of ordinary skill in the art, and thus a detailed description thereof will not be presented.

Referring to FIG. 6, the control unit 130 is mounted on a motherboard, and controls the firing operation of the nozzle unit 112 installed in the ink-jet head 111 and the transferring operation of the printing medium conveying unit. A data input unit 135 receives image data in the order of pages to be printed from an external device such as a personal computer (PC), a digital camera, or a personal digital assistant (PDA).

The control unit 130 stores the image data input through the data input unit 135 in a memory 137, and confirms whether the image data desired to be printed is completely stored in the memory 137. When the storage of the image data is completed, the control unit 130 operates a driving source 131, and the printing medium P is transferred by the printing medium conveying unit which is driven by the driving source 131. The control unit controls the nozzle units 112 to fire ink onto the printing medium P about the time when the printing medium P approaches the nozzle unit 112. Further, the control unit 130 generates and outputs a signal for controlling the operation of the first nozzle array 112A and second nozzle array 112B such that the image data is printed on the printing medium P. The first and second nozzle arrays 112A and 112B receives the control signal and print the image data on the printing medium P. Specifically, to print the image data, a control signal generating portion (not shown) included in the control unit 130 generates the control signals that drive the first and second nozzle arrays 112A and 112B, and the first and second nozzle arrays 112A and 112B receive the control signals to fire the ink. Moreover, the control unit 130 receives an output signal from the defecting unit 132 to detect the defective nozzle of the first nozzle array 112A, and controls the second nozzle array 112B to compensate for a missing dot due to the defective nozzle when the defective nozzle is generated.

Figure 7:
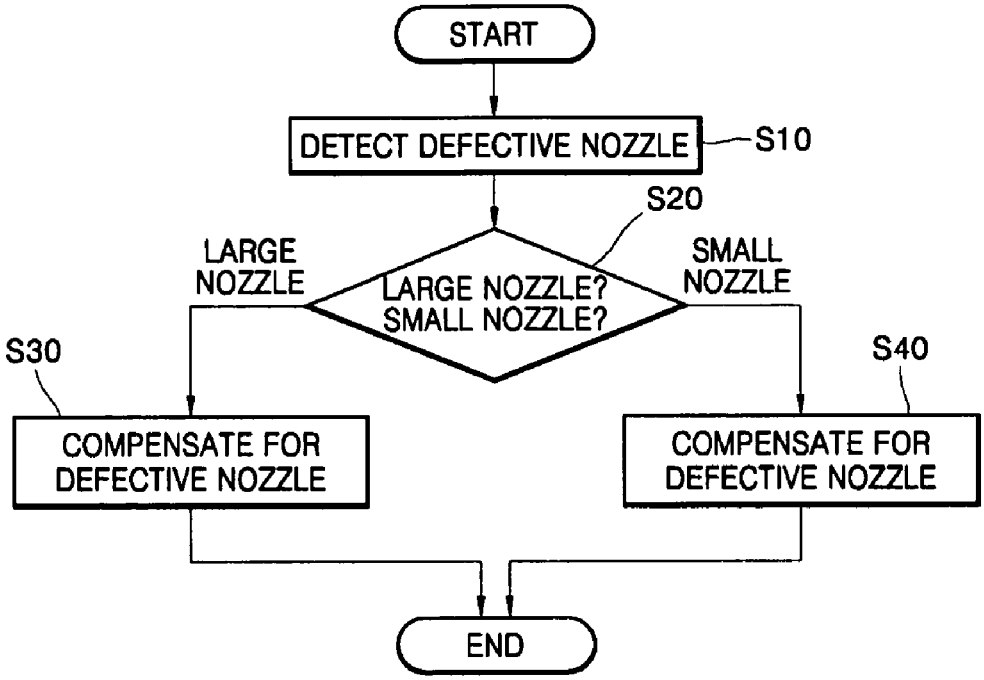
FIG. 7 is a flowchart illustrating a method for compensating for a defective nozzle.
Figure 8A:
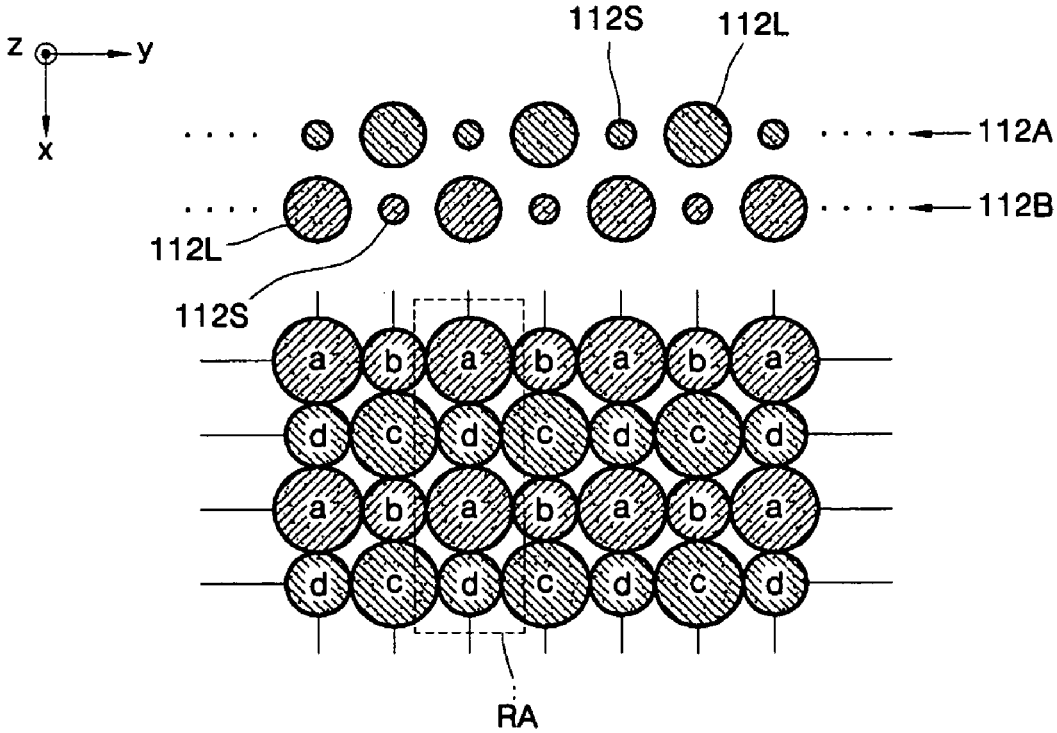
FIG. 8A shows dots printed in a solid pattern by a normally operating nozzle according to an embodiment of the present invention.
Figure 8B:
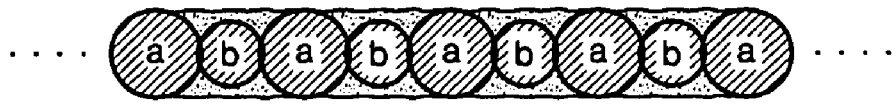
FIG. 8B shows dots actually printed by a nozzle unit of FIG. 4.
Figure 9:
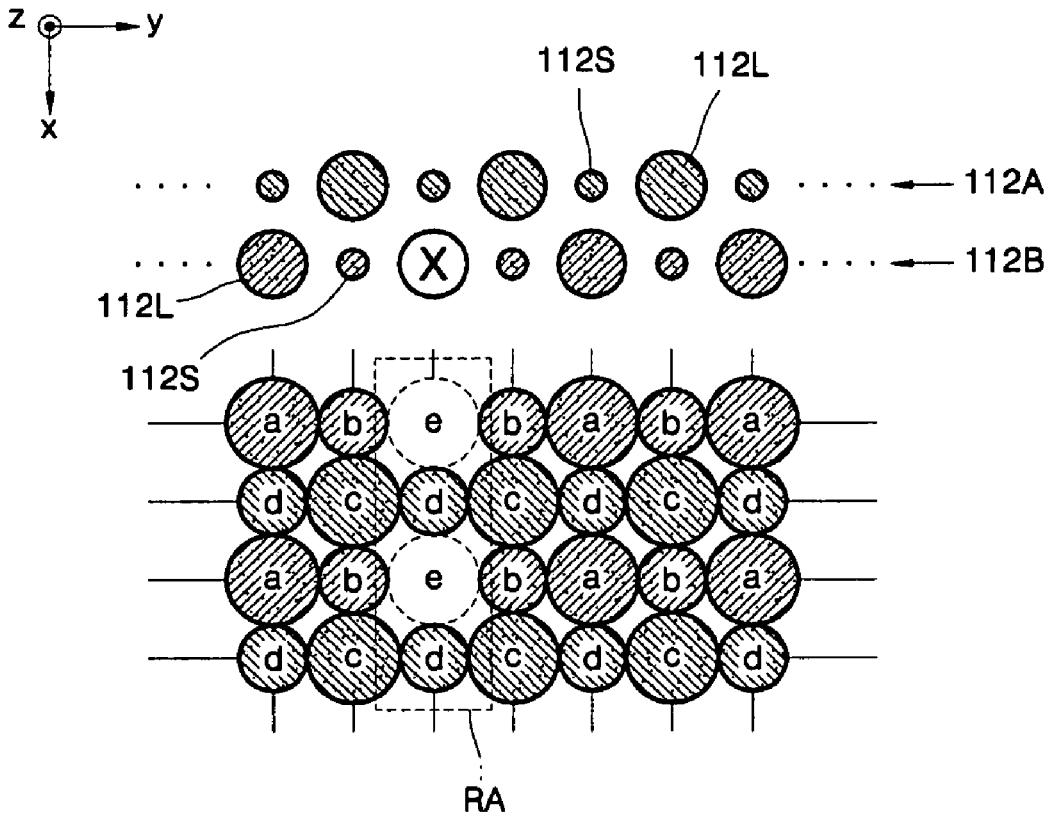
FIG. 9 shows dots printed in case of defect of a large nozzle.
Figure 10:
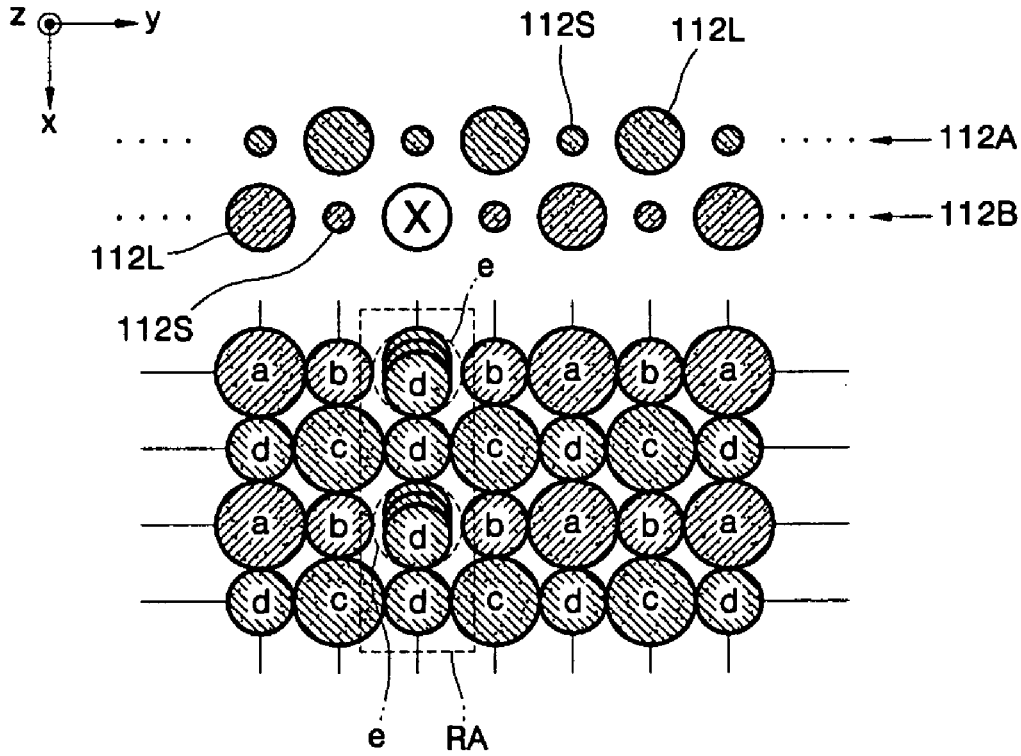
FIG. 10 shows dots when the defect of the nozzle of FIG. 9 is compensated for according to an embodiment of the present invention.
Figure 11:
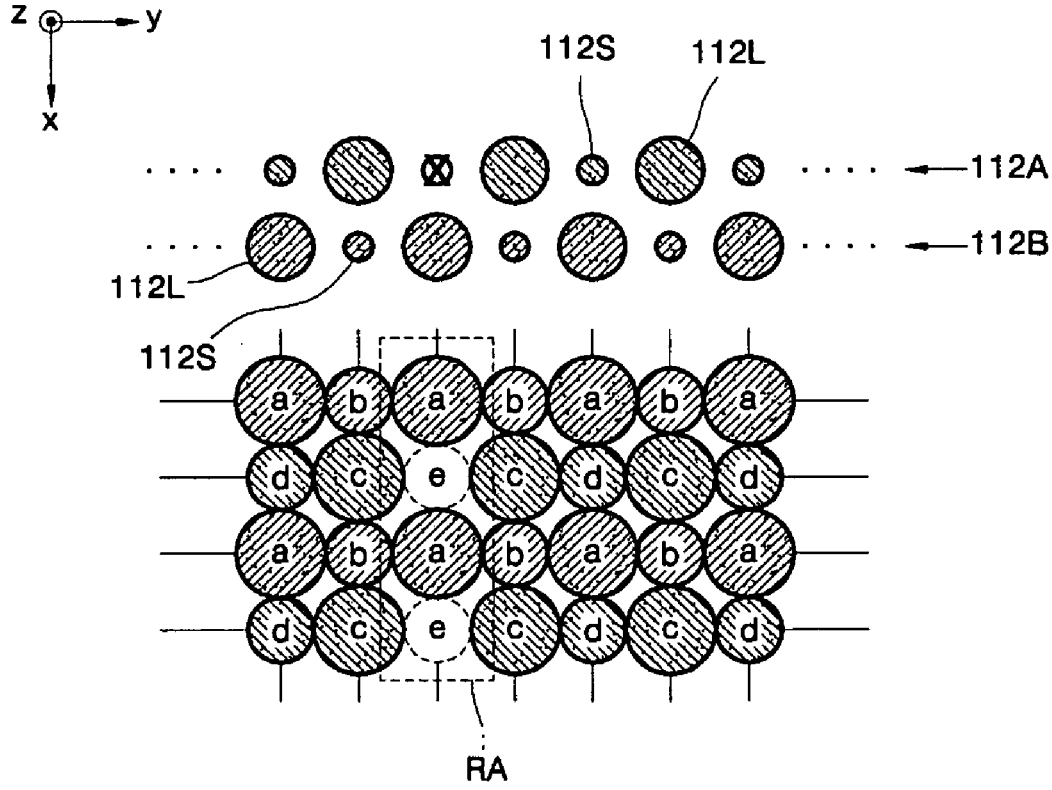
FIG. 11 shows dots printed in case of defect of a small nozzle.
Figure 12:
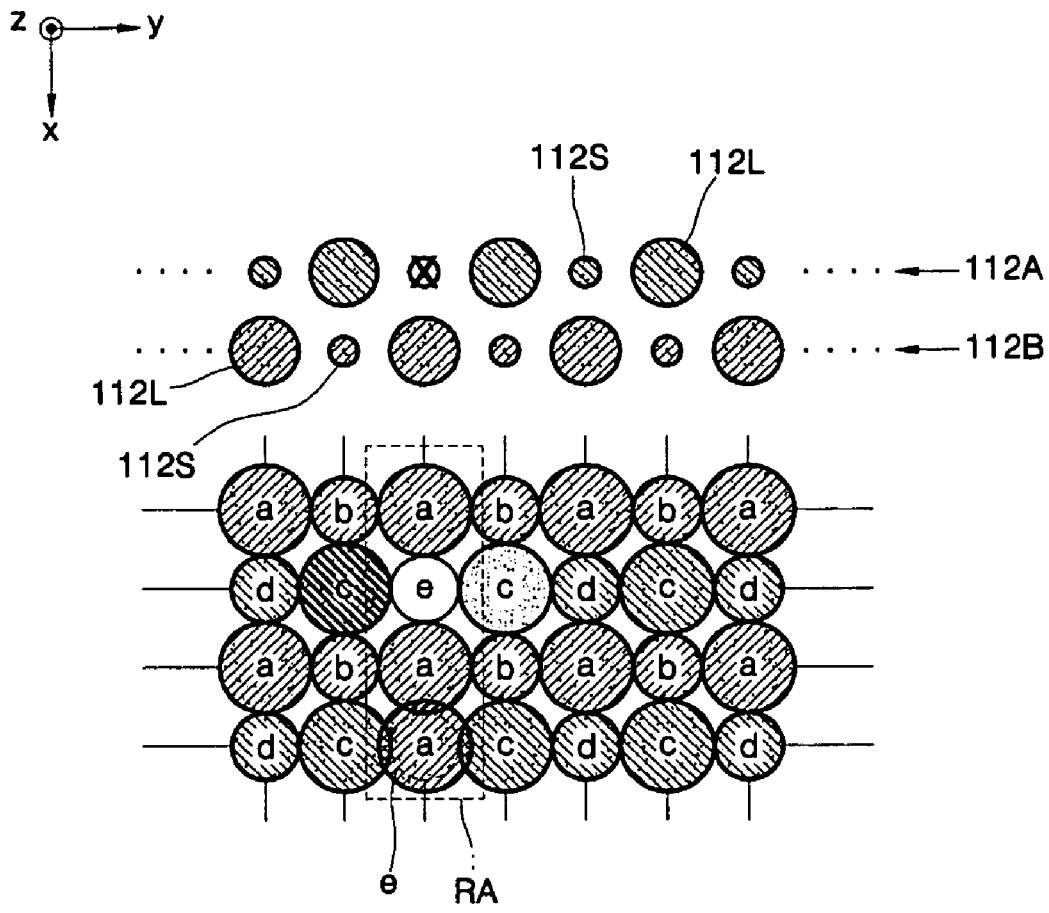
FIG. 12 shows dots when the failure of the nozzle of FIG. 11 is compensated for according to an embodiment of the present invention.

Hereinafter, a method for compensating for the effect of the defective nozzle will be more fully described with respect to FIG. 7, which is a flowchart illustrating a method for compensating for a defective nozzle, FIG. 8A, which shows dots printed in a solid pattern by a nozzle unit according to an embodiment of the present invention that is operating normally, FIG. 8B, which shows dots printed by a nozzle unit according to the embodiment of the present invention, FIG. 9, which shows dots printed in case of defect of a large nozzle, FIG. 10, which shows dots when the defective nozzle of FIG. 9 is compensated for, FIG. 11, which shows dots printed in case of defect of a small nozzle, and FIG. 12, which shows dots when the defective nozzle of FIG. 11 is compensated for. In FIGS. 7-12, 112A denotes a first nozzle array, 112B denotes a second nozzle array, 112L denotes a large nozzle, 112S denotes a small nozzle, 'a' denotes a dot fired from the large nozzle 112L of the second nozzle array 112B, 'b' denotes a dot fired from the small nozzle 112S of the second nozzle array 112B, 'c' denotes a dot fired from the large nozzle 112L of the first nozzle array 112A, 'd' denotes a dot fired from the small nozzle 112S of the first nozzle array 112A, and 'e' denotes a missing dot due to a nozzle defect. While not required in all aspects of the invention, elements of the method can be implemented using computer readable media readable by a general or special purpose computer such as the control unit 130.

Referring to FIG. 7, the method for compensating for the defective nozzle comprises detecting the defective nozzle (operation S10), detecting which nozzle failed among the large and small nozzles (operation S20), and compensating for a missing dot of the defective nozzle (operation S30 and operation S40). By the method according to the present embodiment, printing of a defective nozzle in one of the first and second nozzle arrays 112A and 112B is compensated for using the other nozzle array. FIGS. 9 and 10 are dot images when printing of the defective nozzle of the second nozzle array 112B is compensated for using the first nozzle array 112A, and FIGS. 11 and 12 are dot images when printing of the defective nozzle of the first nozzle array 112A is compensated for using the second nozzle array 112B.

Referring to FIG. 8A, large nozzles 112L and small nozzles 112S are alternately arranged in each of the first nozzle array 112A and second nozzle array 112B. While the printing medium P is transferred in the X direction, dots fired from the first nozzle array 112A and second nozzle array 112B are adhered onto the printing medium P. During printing in a solid pattern, large and small dots are alternately printed in the X direction and in the Y direction on the printing medium P as shown in FIG. 8A. The solid pattern is a printing image of the highest density.

Figure 1B:
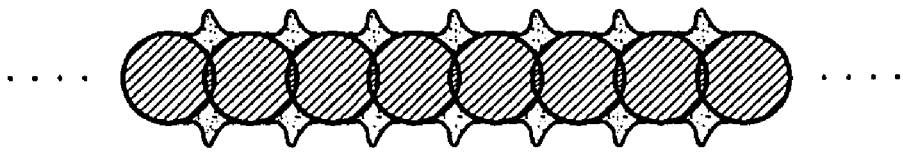
FIG. 1B (RELATED ART)
FIG. 1B shows dots actually printed by the conventional ink-jet image forming apparatus.
Figure 2A:
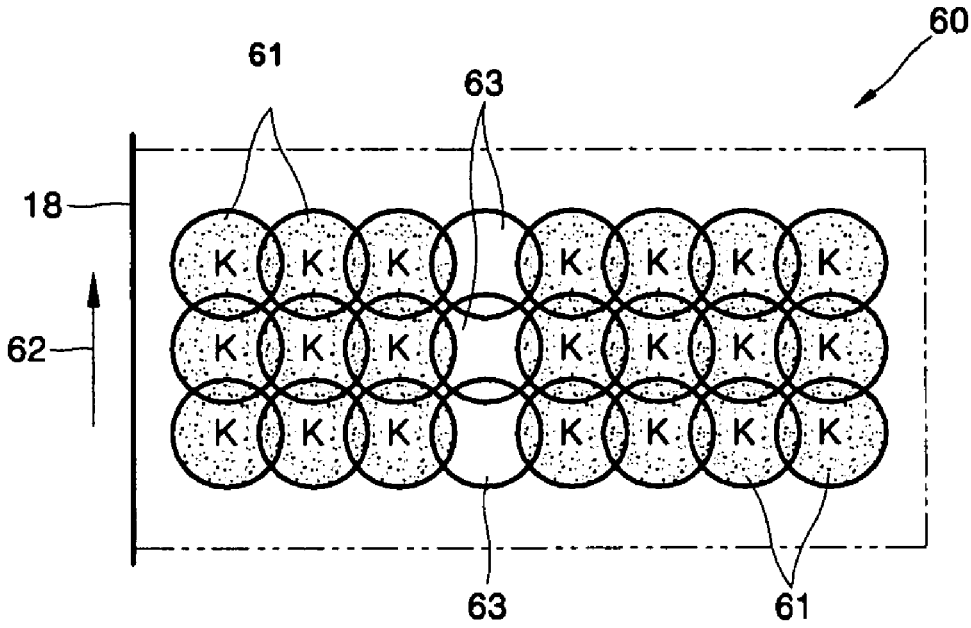
FIG. 2A (RELATED ART)
FIGS. 2A-2D are pixel images for explaining a method for compensating for defective nozzle unit of a conventional ink-jet image forming apparatus.
Figure 2B:
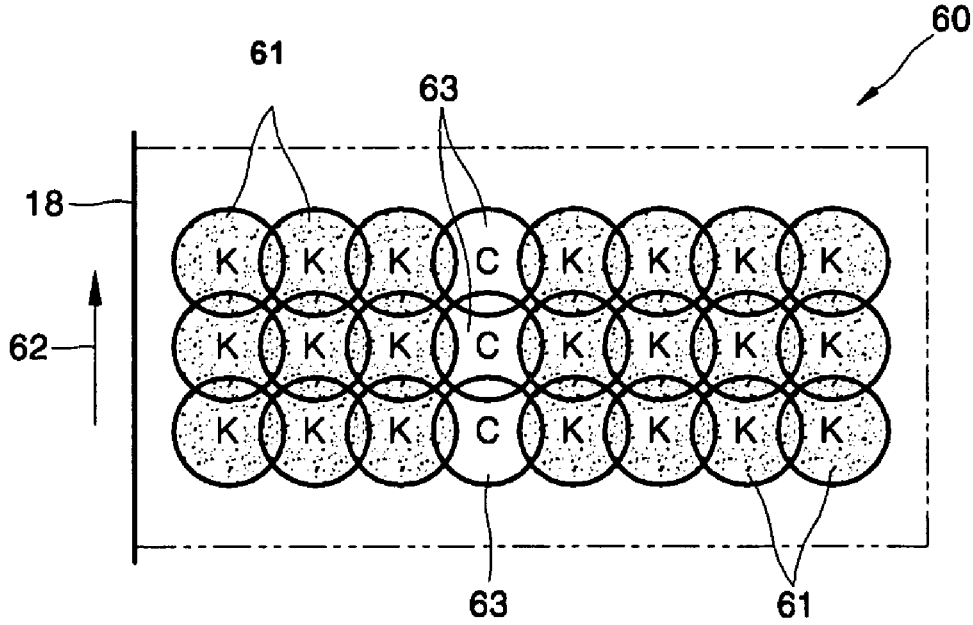
FIG. 2B (RELATED ART)
Figure 2C:
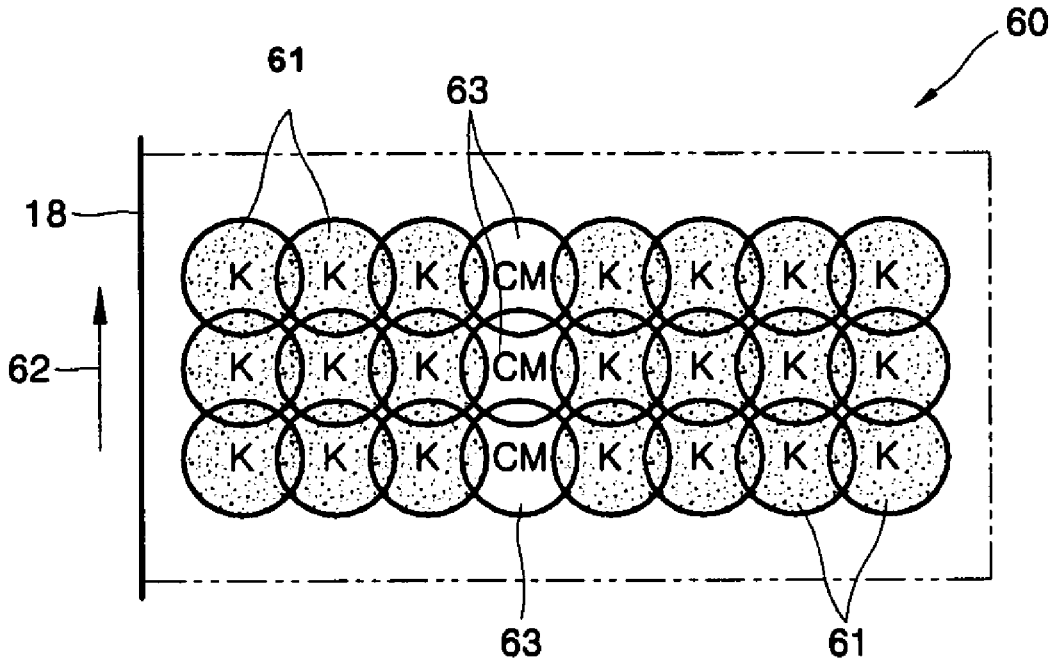
FIG. 2C (RELATED ART)
Figure 2D:
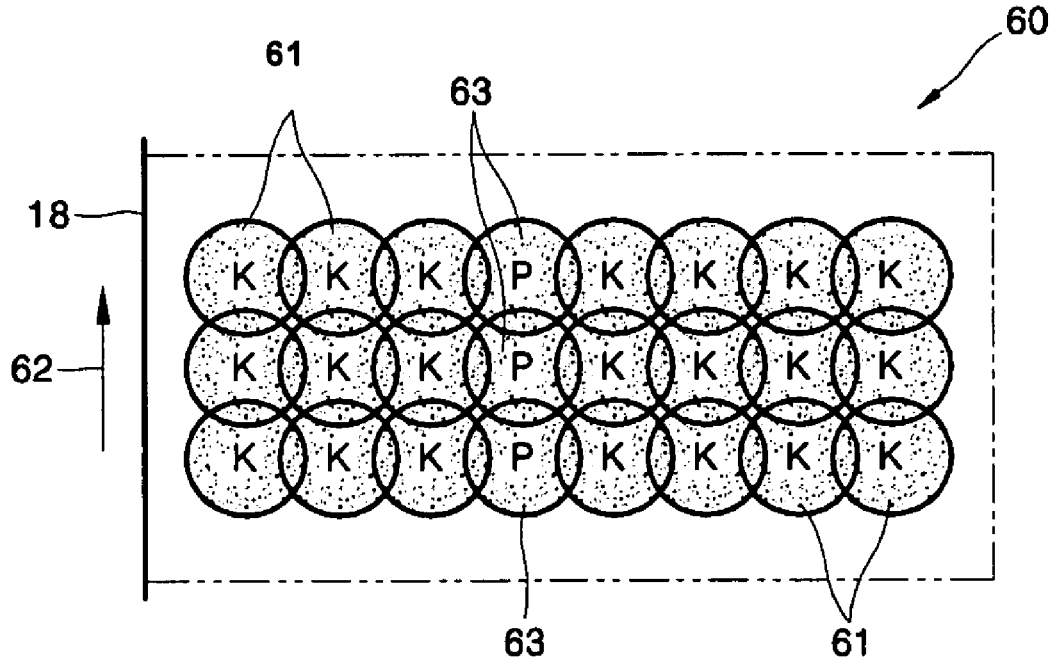
FIG. 2D (RELATED ART)
Figure 3:
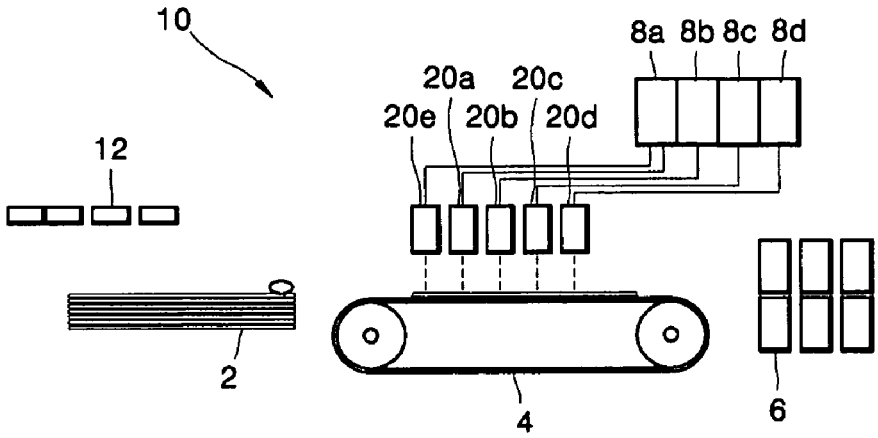
FIG. 3 (RELATED ART)
FIG. 3 is a view for explaining a method for compensating for a defective nozzle unit using a secondary ink-jet head in a conventional ink-jet image forming apparatus.

As shown in FIG. 1B, the printed straight line in the conventional invention is very rough and uneven due to the spreading phenomenon of dots fired onto the printing medium P. However, in the present invention, the large nozzle 112L and the small nozzle 112S act to offset each other as shown in FIG. 8B, and thus printing can be improved. Further, arrangement of the nozzles of the ink-jet head according to aspects of the present invention is more advantageous to optical density, that is, image quality, than the nozzle arrangement of the conventional art. For example, it is assumed that the optical density at a reference area RA decreases by 0.5 when a dot is not fired from the large nozzle 112L and the optical density decreases by 0.3 when a dot is not fired from the small nozzle 112S. Additionally, it is assumed that the size of the large nozzle 112L is the same as the size of the conventional nozzle. In the conventional art where nozzles of the same size are used, when a nozzle fails, the optical density decreases by 0.5. However, since the optical density decreases by 0.5 when one large nozzle 112L fails and the optical density decreases by 0.3 when one small nozzle 112S fails according to aspects of the present invention, the nozzle arrangement according to aspects of the present invention is more advantageous to image quality than that of the conventional art. Thus, nozzle arrangement according to aspects of the present invention improves the image quality. Since the dot fired from the small nozzle 112S has a smaller diameter than that of the dot fired from the large nozzle 112L, a kind of outline effect is achieved. That is, since the dot fired from the small nozzle 112S has a smaller diameter, printing quality is improved.

Referring to FIG. 9, when the large nozzle 112L of the second nozzle unit 112B is defective, missing dots 'e' are alternately generated on the printing medium P. At this moment, the optical density at the reference area RA remarkably decreases. When the large nozzle 112L of the second nozzle unit 112B is defective, the effect of the failed large nozzle 112L is compensated for using the small nozzle 112S of the first nozzle unit 112A (operation S30). At this moment, the small nozzle 112S compensates for the missing dot 'e' of the defective nozzle 112L using at least one dot. That is, the number of dots fired from the small nozzle 112S for compensating for the missing dot 'e' is more than one. Although the spaces between dots are large in FIG. 9, actually neighboring dots substantially overlap each other when ink droplets are fired onto the printing medium P, and thus, there is little white portion where the printing is not performed due to the missing dot 'e'. Accordingly, a single dot fired from the small nozzle 112S can sufficiently compensate for the missing dot 'e'. Meanwhile, when an image of high print density or a high-resolution image is output, appropriate optical density must be maintained to obtain high image quality. That is, according to the printing environment, not a single dot but a plurality of dots may be required for compensating for the missing dot, as shown in FIG. 10, in case of the defective nozzle 112L.

Therefore, the control unit 130 may control the firing operation of the nozzle unit 112 such that the nozzle unit 112 compensates for the missing dot 'e' using an optimal number of dots suitable for each printing environment. The optimal number of the dots for compensation depends on the printing environment. Thus, the control unit 130 may further include a memory unit in which results of preceding experiments in various printing environments are stored.

It is preferable, but not required, that the compensation is performed such that the difference between the optical density when the large nozzle 112L normally fires ink and the optical density when the small nozzle 112S compensates for the missing dot 'e' is less than 0.2. This is because a user cannot perceive a difference in the image quality when the difference of optical density is less than 0.2.

When the small nozzle 112S of the first nozzle array 112A is defective, the missing dots 'e' are alternately generated on the printing medium P as shown in FIG. 11. When the small nozzle 112S of the first nozzle 112A is defective, compensation is performed using the large nozzle 112L of the second nozzle array 112B (operation S40). In this compensation method, it is preferable, but not required, that the large nozzle 112L compensates for the missing dots 'e' using dots less than the number of the missing dots 'e'. In other words, the number of dots fired from the large nozzle 112L is less than the number of the missing dots 'e'. As shown, the number of compensated missing dots 'e' is half of the number of missing dots 'e'. However, it is understood that the ratio can be adjusted according to aspects of the invention.

Although the spaces between dots are exaggerated in FIG. 11, there is little white portion where printing is not performed due to the missing dots since the neighboring dots substantially overcome each other when ink droplets are fired onto the printing medium P. Therefore, if the missing dots 'e' due to the failed small nozzle 112S are compensated for using the same number of the large dots as the missing dots 'e', more ink is consumed. In such a case where ink is excessively used, the image quality may be deteriorated due to the spreading or overlapping phenomenon of ink. Furthermore, the printing medium P may curl due to the excessive ink, resulting in the deterioration of the image quality. To prevent this deterioration of the image quality, the missing dots 'e' are compensated using fewer large dots than the missing small dots as shown in FIG. 12. It is preferable, but not required, that the difference in the optical density when the small nozzle 112S normally fire ink and when the compensation is performed using the above method is less than 0.2. This is because a user cannot recognize the difference in image quality when the difference of the optical density is less than 0.2. However, it is understood that other densities can be used varying according to the type of ink, color, and/or paper type.

Figure 13:
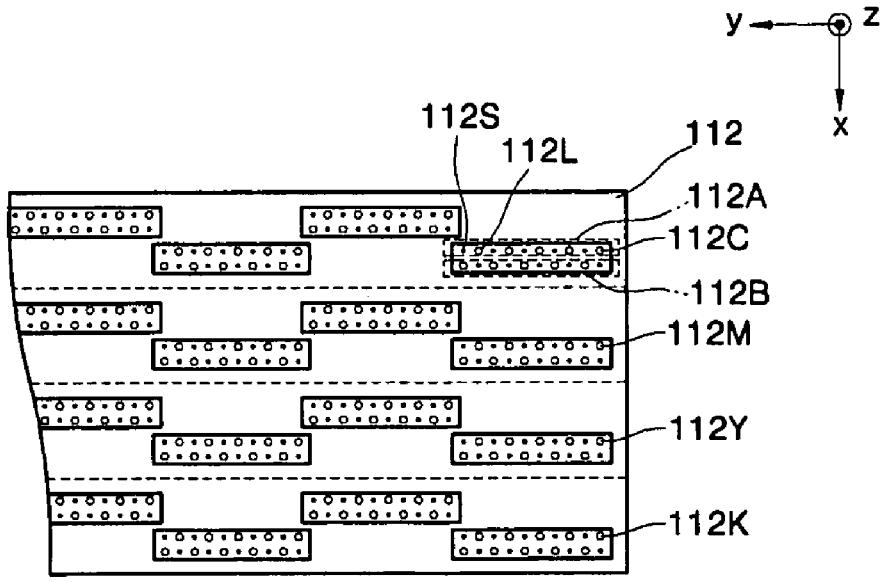
FIG. 13 is a bottom view of an ink-jet head unit according to another embodiment of the present invention.

Although the nozzle unit 112 firing ink of one color has been described as an example of the present invention, the present invention is not limited thereto and is applicable to a color ink-jet image forming apparatus. The nozzle unit 112 included in a color ink-jet image forming apparatus is illustrated in FIG. 13. Reference numerals 112C, 112M, 112Y, and 112K denote nozzle units firing ink of cyan, magenta, yellow, and black colors, respectively. Further, reference numerals 112A, 112B, 112L, and 112S denote a first nozzle unit, a second nozzle unit, a large nozzle, and a small nozzle, respectively.

According to aspects of the present invention, the ink-jet image forming apparatus can selectively compensate for a missing dot generated due to a defective nozzle according to the printing environment. Further, embodiments of the present invention can selectively adjust the number of dots used for compensation according to the printing environment. That is, aspects of the present invention appropriately compensates for the effect of a defective nozzle, thereby improving the image quality or minimizing the influence of the defective nozzle on the image quality.

As described above, in an ink-jet head, according to aspects of the present invention, an ink-jet image forming apparatus including the ink-jet head, and a method for compensating for a defective nozzle, two nozzle arrays are installed in parallel with each other and large and small nozzles are alternately arranged in each nozzle array. Further, since large and small dots are fired from the large and small nozzles, the dots are offset, thereby reducing the deterioration of image quality. Moreover, when the large nozzle of one of nozzle arrays is defective, the compensation is performed using a small nozzle of the other nozzle array, and thus ink can be saved. Additionally, when the large nozzle is defective, the image quality can be improved by performing compensation using a plurality of dots according to a printing environment. When the small nozzle is defective, missing dots due to the failed small nozzle are compensated for using fewer dots than the missing dots, and thereby curling of a printing medium can be prevented. The compensation effect can be increased by arranging the two nozzle arrays in parallel with each other and controlling the arrangement of nozzles disposed on each of the nozzle arrays. Further, the influence of the defective nozzle on the image quality can be minimized regardless of the colors of ink.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An ink-jet head, comprising:

a nozzle unit including a first nozzle array having a plurality of nozzles of different sizes and at least one second nozzle array having another plurality of nozzles of different sizes, wherein the nozzles of different sizes of the first nozzle array includes a plurality of first nozzles having a first size and a plurality of second nozzles having a second size other than the first size, and the first and second nozzles are alternately arranged, the another plurality of nozzles of different sizes of the second nozzle array includes a plurality of third nozzles having a third size and a plurality of fourth nozzles having a fourth size other than the third size, and the third and fourth nozzles are alternately arranged, adjacent pairs of nozzles of the first nozzle array and the nozzles of the second nozzle array are disposed parallel to a feeding direction of a printing medium, and adjacent pairs of nozzles of the first nozzle array and the second nozzle array in the parallel direction have different sizes from each other.

2. The ink-jet head of claim 1, wherein the adjacent pairs of nozzles include large and small nozzles which are alternately arranged in each of the first nozzle array and second nozzle array.

3. The ink-jet head of claim 2, wherein a length of the nozzle unit corresponds to the width of the printing medium.

4. The ink-jet head of claim 1, wherein the second nozzle array is disposed parallel to the first nozzle array.

5. An ink-let image forming apparatus, comprising:

an ink-jet head including a nozzle unit having a first nozzle array in which pairs of large and small nozzles are alternately arranged and at least one second nozzle array in which pairs of large and small nozzles are alternately arranged, wherein:

the pairs of large and small nozzles arranged in the first nozzle array and the other pairs of large and small nozzles arranged in the second nozzle array are disposed parallel to a feeding direction of a printing medium, and sizes of opposite nozzles in the first nozzle array and the second nozzle array are different from each other.

6. The ink-jet image forming apparatus of claim 5, wherein a length of the nozzle unit corresponds to a width of the printing medium.

7. The ink-jet head of claim 5, wherein the second nozzle array is disposed parallel to the first nozzle array.

8. The ink-jet image forming apparatus of claim 5, further comprising:

a controller which compensates for a detected defective nozzle in one of the first and second nozzle arrays by controlling a firing of a corresponding nozzle in the other one of the first and second nozzle arrays.

9. The ink-jet image forming apparatus of claim 8, wherein the corresponding nozzle in the other one of the first and second nozzle arrays fired to compensate for the detected defective nozzle has a size other than a size of the detected defective nozzle.

10. The ink-jet image forming apparatus of claim 9, wherein the first nozzle array and the second nozzle array are arranged parallel to each other in a direction perpendicular to the feeding direction of the printing medium and are spaced apart in the feeding direction.

11. The ink-jet image forming apparatus of claim 8, wherein when the large first nozzle of the first nozzle array is detected to be defective, the corresponding nozzle is the small second nozzle of the second nozzle array, and the controller causes the corresponding small nozzle of the second nozzle array to fire a plurality of ink dots to compensate for the defective large nozzle.

12. The ink-jet image forming apparatus of claim 8, wherein when the small first nozzle of the first nozzle array is detected to be defective, the corresponding nozzle is the second large nozzle, and the controller causes the corresponding large nozzle of the second nozzle array to fire a number of times, which is less than a number of times the small nozzle of the first array would have fired if it operated normally.

13. A method of compensating for a defective nozzle in an ink-jet image forming apparatus which includes a nozzle unit having a first nozzle array including a plurality of nozzles of different sizes and a second nozzle array including another plurality of nozzles of different sizes, the method comprising:

detecting a defective nozzle of the first nozzle array; and compensating for the defective nozzle using the second nozzle array.

14. The method for claim 13, wherein the plurality of nozzles of different sizes of the first nozzle array are alternately arranged.

15. The method for claim 14, wherein the other plurality of nozzles of different sizes of the second nozzle array are alternately arranged.

16. The method for claim 15, wherein pairs of large and small nozzles are alternately arranged in each of the first nozzle array and second nozzle array parallel to a feeding direction of a printing medium, and opposite nozzles of the first nozzle array and the second nozzle array are different sizes from each other.

17. The method for claim 16, wherein the compensating for the defective nozzle comprises, compensating for the defective large nozzle of the first nozzle array using the small nozzle of the second nozzle array.

18. The method for claim 17, wherein each of the defective large nozzles of the first nozzle array is compensated for using at least one firing of the small nozzle of the second array corresponding to the defective large nozzle of the first nozzle array.

19. The method for claim 18, wherein ink dots are fired from the small nozzle of the second nozzle array such that the difference in optical density when the large nozzle of the first nozzle array normally fires ink dots and when the small nozzle of the second nozzle array compensates for the defect of the large nozzle of the first nozzle array is less than 0.2.

20. The method for claim 16, wherein the compensating for the defective nozzle comprises, compensating for the defective small nozzle of the first nozzle array using the large nozzle of the second nozzle array.

21. The method for claim 20, wherein the defective small nozzles of the first nozzle array are compensated for using fewer firings of the large nozzle of the second nozzle array than the defective firings of the small nozzle of the first nozzle array.

22. The method for claim 21, wherein the dots are fired from the large nozzle of the second nozzle array such that the difference in optical density when the small nozzle of the first nozzle array normally fires ink dots and when the large nozzle of the second nozzle array compensates for the defect of the small nozzle of the first nozzle array is less than 0.2.

23. The method for claim 16, wherein a length of the nozzle unit corresponds to a width of the printing medium.

24. The method for claim 13, wherein the second nozzle array is disposed parallel to the first nozzle array.

25. An ink-jet head, comprising:

a nozzle unit including a first nozzle array having a plurality of first nozzles of different sizes and at least one second nozzle array having another plurality of second nozzles of different sizes, adjacent pairs of the first and second nozzles of the first and second nozzle arrays are disposed parallel to a feeding direction of a printing medium.

26. An ink-jet image forming apparatus, comprising:

an ink-jet head including a nozzle unit having a first nozzle array in which pairs of large and small first nozzles are alternately arranged and at least one second nozzle array in which pairs of large and small second nozzles are alternately arranged, wherein adjacent pairs of the first nozzles and the second nozzles of the first and second nozzle arrays are disposed parallel to a feeding direction of a printing medium.

* * * * *

UNITED STATES PATENT AND TRADEMARK OFFICE

CERTIFICATE OF CORRECTION

PATENT NO. : 7,484,830 B2
APPLICATION NO. : 11/292006
DATED : February 3, 2009
INVENTOR(S) : Tae-kyun Kim et al.

It is certified that error appears in the above-identified patent and that said Letters Patent is hereby corrected as shown below:

Column 12, line 65, change “ink-let” to --ink-jet--.

Signed and Sealed this

Twenty-fourth Day of March, 2009

JOHN DOLL
*Acting Director of the United States Patent and Trademark Office*